US006298898B1

(12) United States Patent
Mahadeva et al.

(10) Patent No.: US 6,298,898 B1
(45) Date of Patent: Oct. 9, 2001

(54) OPTIMIZING CYCLE TIME AND/OR CASTING QUALITY IN THE MAKING OF CAST METAL PRODUCTS

(75) Inventors: Shivantha Mahadeva, Canton, MI (US); Darius Pradhir Kumar Singh, Auckland (NZ); Doug Muller, Auckland (NZ); Geoff Martin, Auckland (NZ); Philip Renwick, Auckland (NZ)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/348,626

(22) Filed: Jul. 6, 1999

(51) Int. Cl.[7] ..... B22D 46/00; G06F 19/00
(52) U.S. Cl. ..... 164/4.1; 700/147
(58) Field of Search ..... 164/4.1, 457, 458; 700/147, 146

(56) References Cited

U.S. PATENT DOCUMENTS

| | | | | |
|---|---|---|---|---|
| 3,583,467 | * | 6/1971 | Bennett | 164/4 |
| 4,210,193 | | 7/1980 | Ruhle . | |
| 4,213,494 | * | 7/1980 | Carbonnel | 164/4 |
| 4,671,342 | | 6/1987 | Balevski et al. . | |
| 4,976,305 | | 12/1990 | Tanaka et al. . | |
| 5,647,426 | * | 7/1997 | Prieto et al. | 164/348 |
| 5,677,844 | * | 10/1997 | Kubo | 364/72.02 |
| 5,841,669 | * | 11/1998 | Purvis et al. | 364/554 |
| 5,868,194 | * | 2/1999 | Horwood | 164/456 |
| 5,872,714 | | 2/1999 | Shaikh et al. . | |
| 5,937,265 | * | 8/1999 | Pratt et al. | 419/6 |

FOREIGN PATENT DOCUMENTS

| | | |
|---|---|---|
| 0 655 667 A2 | 5/1995 | (EP) . |
| 0 781 625 A1 | 7/1997 | (EP) . |
| 0 787 547 A1 | 8/1997 | (EP) . |
| 2 230 981 A | 11/1990 | (GB) . |
| 2 309 658 A | 8/1997 | (GB) . |
| 2 320 969 A | 7/1998 | (GB) . |
| 2-205246 | 8/1990 | (JP) . |
| 1650340 | 5/1991 | (RU) . |
| 1668024 A1 | 8/1991 | (RU) . |
| 1741963 A1 | 6/1992 | (RU) . |

OTHER PUBLICATIONS

Article in "*Fonderie*", vol. 35, No. 401 (1980) p. 279–295 "Development of Thermal Steady States in Naturally–Cooled Chills: A Theoretical and Experimental Study".

* cited by examiner

*Primary Examiner*—Tom Dunn
*Assistant Examiner*—Len Tran
(74) *Attorney, Agent, or Firm*—Joseph W. Malleck

(57) ABSTRACT

A method of optimizing cycle time and/or casting quality in the making of a cast metal product which has been defined by a CAD product model. The method involves the steps of (a) providing a computer casting model using objective functions that simulate the filling and solidification of the CAD product model within dies, the casting model being subdivided into contiguous regions with each region having terms in at least one of the objective functions for thermal conductivity, heat capacity and cooling time period, (b) populating the objective function terms with experimental data to calibrate the casting model, derive matching heat 1s transfer coefficients for each region, and simulate filling and solidification of the product within the dies, and (c) constraining the objective functions to ensure directional solidification along the series of contiguous sections while optimizing thermal conductivity and heat capacity and iteratively evaluating the constrained objective functions to indicate at least certain regions of the casting model whereby chills and cooling channels may be added, or insulation added to effect improved cycle time and/or casting quality.

5 Claims, 12 Drawing Sheets t=0.46 sec.

t=1.13 sec.

t=1.92 sec.

t=2.95 sec.

t=4.59 sec.

t=5.29 sec.

OPTIMIZING CYCLE TIME AND/OR CASTING QUALITY IN THE MAKING OF CAST METAL PRODUCTS

TECHNICAL FIELD

This invention relates to the technology of optimizing the design of casting molds by using computer models to obtain improved productivity and/or casting quality, and more particularly, to the use of computer models that focus on the thermal characteristics of the mold to predict optimum location of chills, cooling circuits and insulation.

DISCUSSION OF THE PRIOR ART

Design strategies for casting processes have ranged from experimental trial and error on the plant floor (including manual computational trials) to avoid casting cracks from cooling to automated optimization die design methods, the latter being the current state of the art. Traditionally, foundry die design is finalized when experimental trials in the foundry yield a good casting; such strategy typically involves large design lead times, high scrap rates, and less than optimum production rates. The flow diagram for the current commercial state of the art in this technology is illustrated in FIG. 1. As shown, the casting product is first designed and redesigned as per finite element analysis with regard to stress, noise-vibration-handling, and fatigue. Tooling (dies) is then designed based on the designer's accumulated knowledge and then tried out experimentally, resulting in redesign by trial and error.

Apart from the current state of the art, others have calculated the cooling requirements for the mold using computational models with estimated material and boundary properties to roughly predict the effects of cooling variations which again require trials to optimize. Computer optimization of die design has incorporated features to consider shape and process parameters, but thermal characteristics of the die were not considered or focused upon.

SUMMARY OF THE INVENTION

What is needed is an improved method for the overall casting process that uses a structural design approach for determining optimum location of chills, cooling circuits and insulation in the die or mold to reduce cycle time and thereby increase production capacity along with an increase in casting quality. An aspect of this invention that fully meets such need draws together certain unique steps which in combination create a unique design method by: (i) using experimental data to calibrate a casting process simulation model, (ii) creating a computer solidification model of the casting process simulation model for the mold or die, and (iii) numerically optimizing the computer solidification model to tune the model for locating heat sinks, chill, cooling circuits and insulation.

In more particularity, the invention is a method of optimizing cycle time and/or casting quality in the making of a cast metal product which has been defined by a CAD product model, comprising the steps of (a) providing a computer casting model using objective functions that simulate the filling and solidification of the CAD product model within dies, the casting model being subdivided into contiguous regions with each region having terms in at least one of the objective functions for thermal conductivity, heat capacity and cooling time period, (b) populating the objective function terms with experimental data to calibrate the casting model, derive matching heat transfer coefficients for each region, and simulate filling and solidification of the product within the dies, and (c) constraining the objective functions to ensure directional solidification along the series of contiguous sections while optimizing thermal conductivity and heat capacity and iteratively evaluating the constrained objective functions to indicate at least certain regions of the casting model whereby chills and cooling channels may be added, or insulation added to effect improved cycle time and/or casting quality.

DETAILED DESCRIPTION AND BEST MODE

Figure 1:
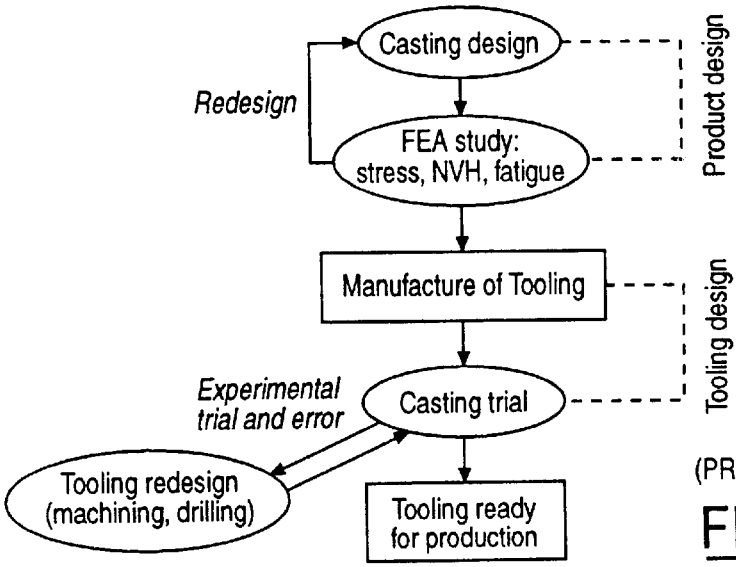
(PRIOR ART) FIG. 1
FIG. 1 is a flow diagram of the steps in current commercial state-of-the-art methods for designing dies to make cast metal products.
Figure 2:
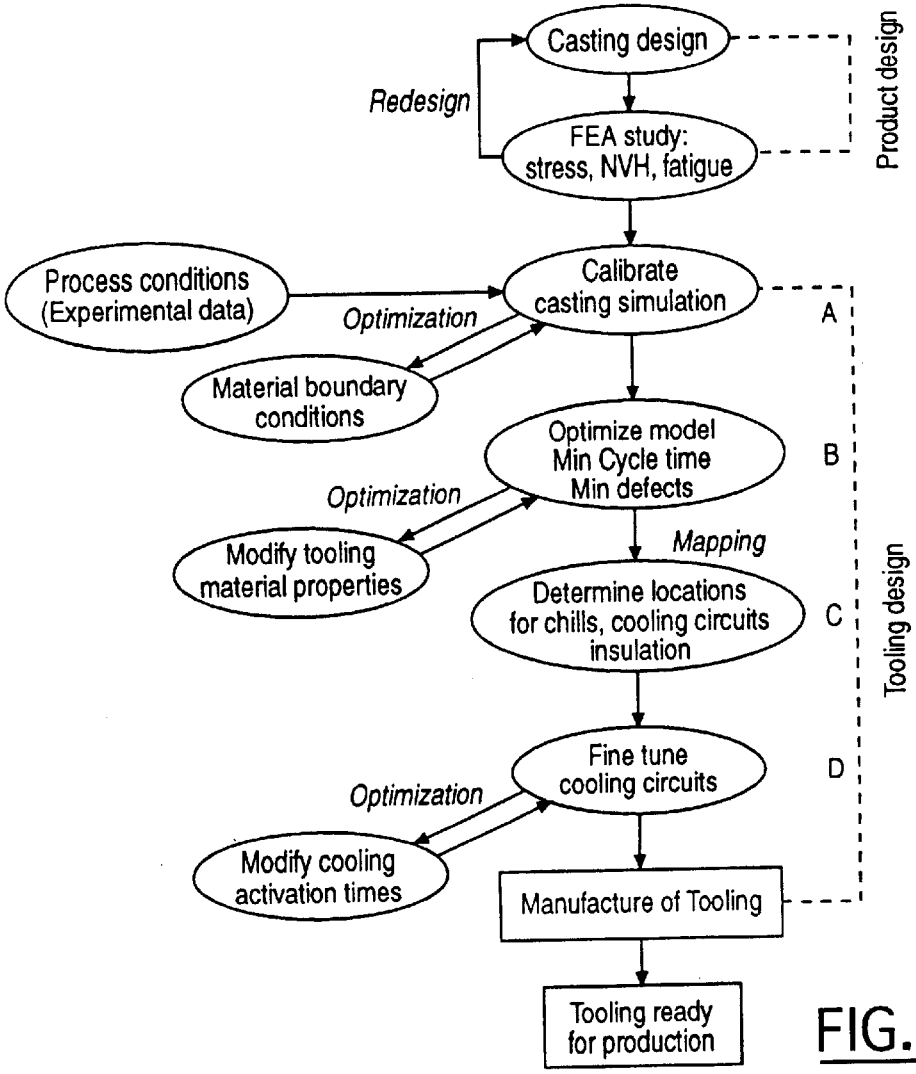
FIG. 2 is a flow diagram, similar to that in FIG. 1, but illustrating the steps used in a preferred embodiment for the method of this invention.

The method of this invention combines thermal analysis with optimization of objective functions for each subdivided region of a casting die to predict modifications needed to achieve an optimized cycle time quality. The modifications may include locating chills, locating insulation, controlling the cooling circuit on and off times and varying the thickness of the die or mold. FIG. 2 shows the methodology in some detail; it shows that the die-making stage is performed only after the modeling and optimization results have been mapped to determine real locations for cooling circuits and insulation. Compared with the traditional approach (FIG. 1) which involves lengthy experimental trials between the tooling manufacture and production readiness steps, it is evident that significant savings in design lead time and production costs can be obtained. The optimization analysis is constrained to ensure uni-directional solidification throughout the casting, which is important to prevent defects such as porosity and cracks.

Figure 3:
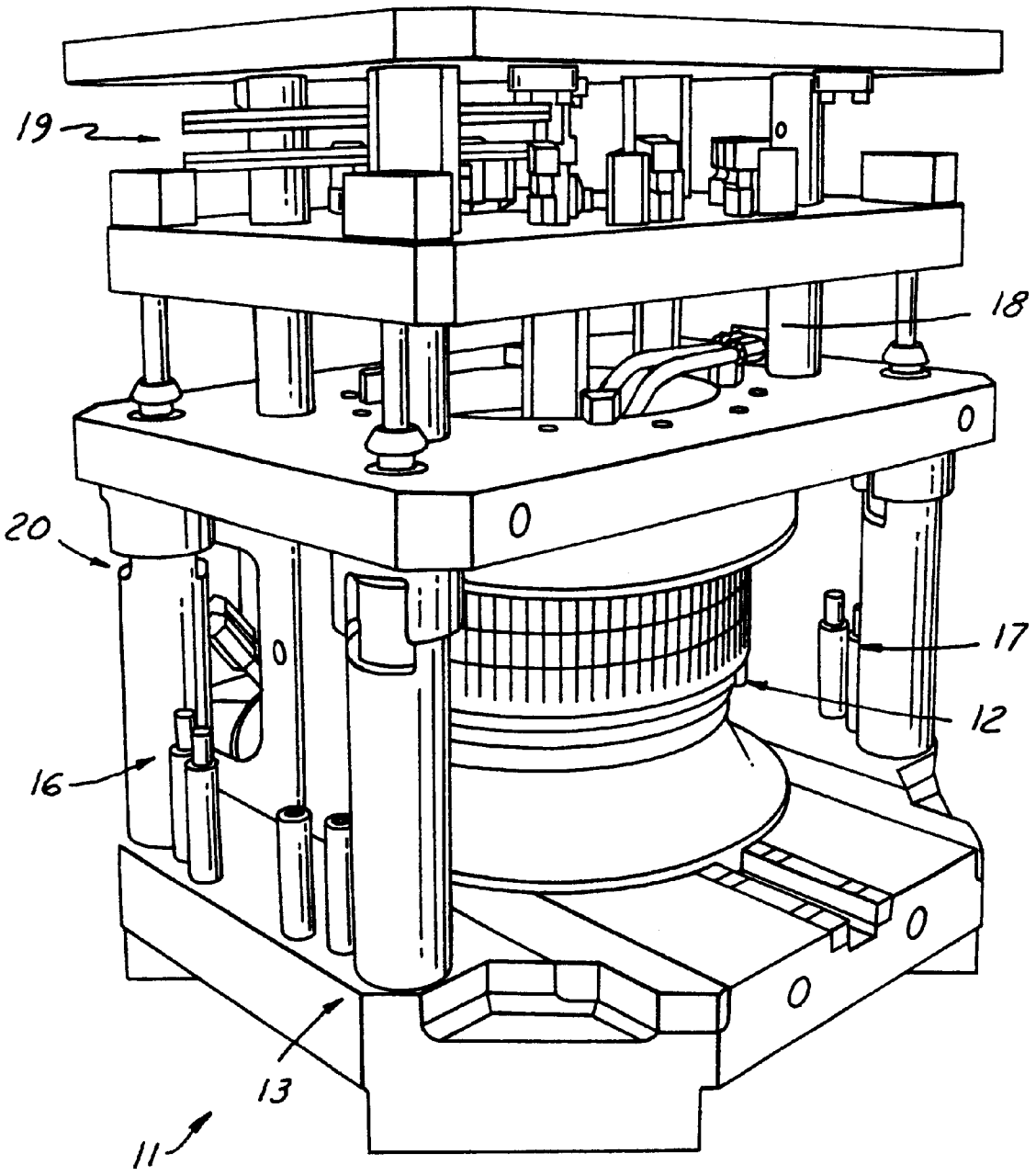
FIG. 3 is a perspective view of a die assembly, and associated cooling circuits, for making a cast aluminum wheel having its elements evaluated and designed according to this invention.
Figure 4:
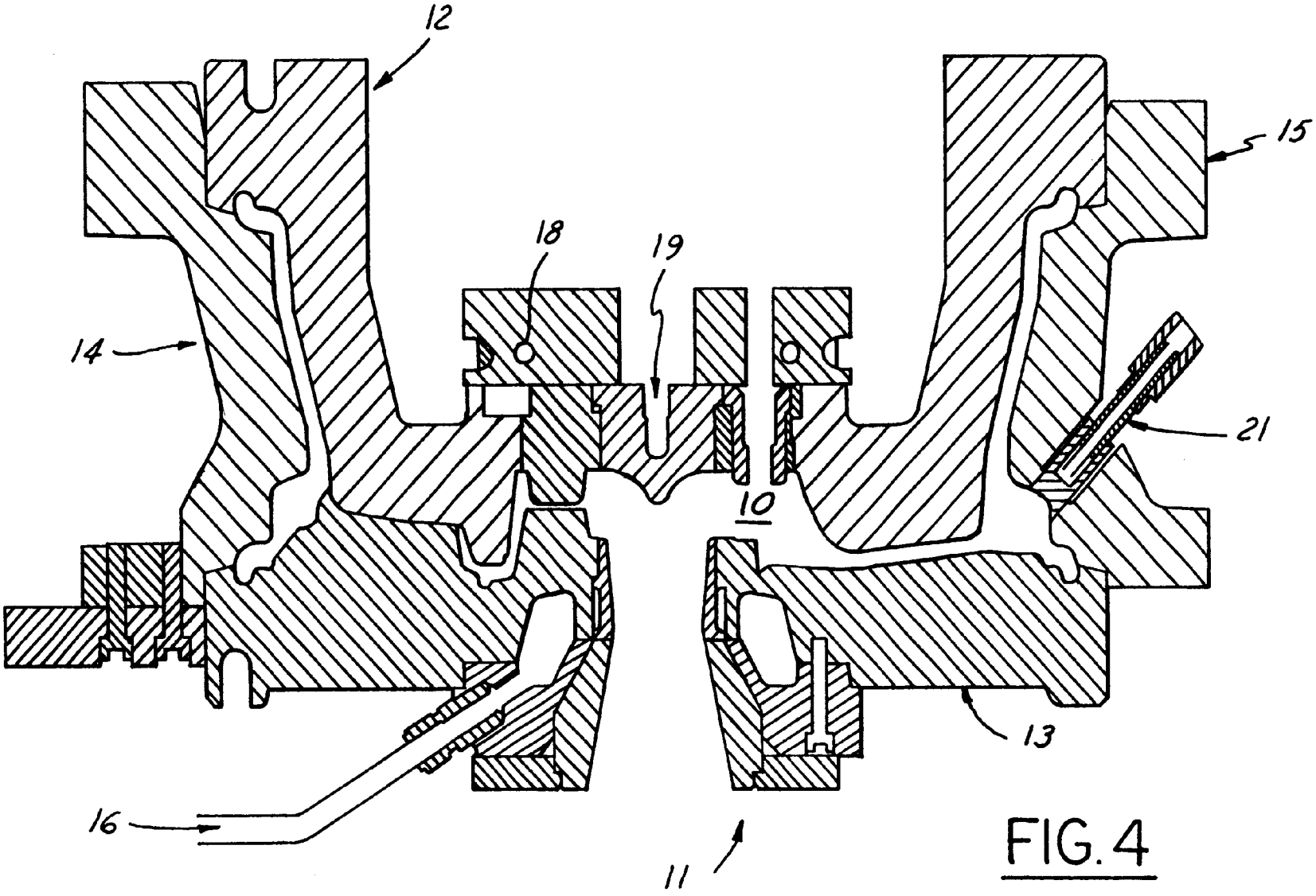
FIG. 4 is a central sectional elevational view of the die assembly of FIG. 3, showing the three basic die elements (top, side and bottom dies) as well as connecting portions of three cooling circuit inlets.

As shown in FIGS. 3 and 4, the preferred embodiment applies the method to casting an aluminum automotive wheel; a molten aluminum alloy (such as A356 poured at a temperature of 730° C.) is injected into a cavity 10 created and surrounded by steel mold elements (such as H13 die steel heated to 450° C.) that form a mold assembly 11. The assembly 11 has a top die 12, a bottom die 13, and side dies 14, 15, each with a cooling circuit inlet. Cooling circuits for the dies are: circuits 16 and 17 for the bottom die, circuits 18 and 19 for the top die, and circuits 20, 21 for the side dies.

Given a wheel product design, which can be redesigned by finite element analysis to accommodate anticipated stress, NVH considerations, and fatigue, the redesigned model is then used in the tooling design of this invention.

The design of the tooling requires provision of a finite element solidification computer model. A useful software package for this is provided by Procast™, which software is an extension of a University Research Program initiated in 1993 at the University of Illinois with the goal of developing better methods for casting analysis. However, unlike Procast™, which uses heat transfer coefficients as design variables, this invention uses thermal conductivity, heat capacity and cooling circuit time periods (switched on and off) as the critical design variables. Additionally and more importantly, the invention further subdivides the die assembly into a number of contiguous but separate regions. Thus, the differing derived thermal conductivities, heat capacity and cooling time periods can predict ideal locations for chills and insulation. Differing derived time periods for the cooling channels 16–21, which are to be switched on and off, provide optimum heat extraction.

The Procast™ software provides a computer casting model using an objective function that simulates the filling and solidification of the CAD product model within dies (the CAD product model must be an accurate representation of the existing product design to proceed further); as indicated, the casting model is subdivided into contiguous regions with each region having terms for thermal conductivity and cooling time periods. The objective function terms are then populated with experimental data to (i) calibrate the casting model with measured thermal data, (ii) derive matching thermal conductivity and heat capacity for each region, and (iii) simulate filling and solidification of the product within the dies. The objective function selected for use with Procast™ was $F(b)=(t_f-400.0)^2$. This function is optimized by minimization for our purposes. The function is written as the difference between a known and a predicted quantity.

Figure 5:
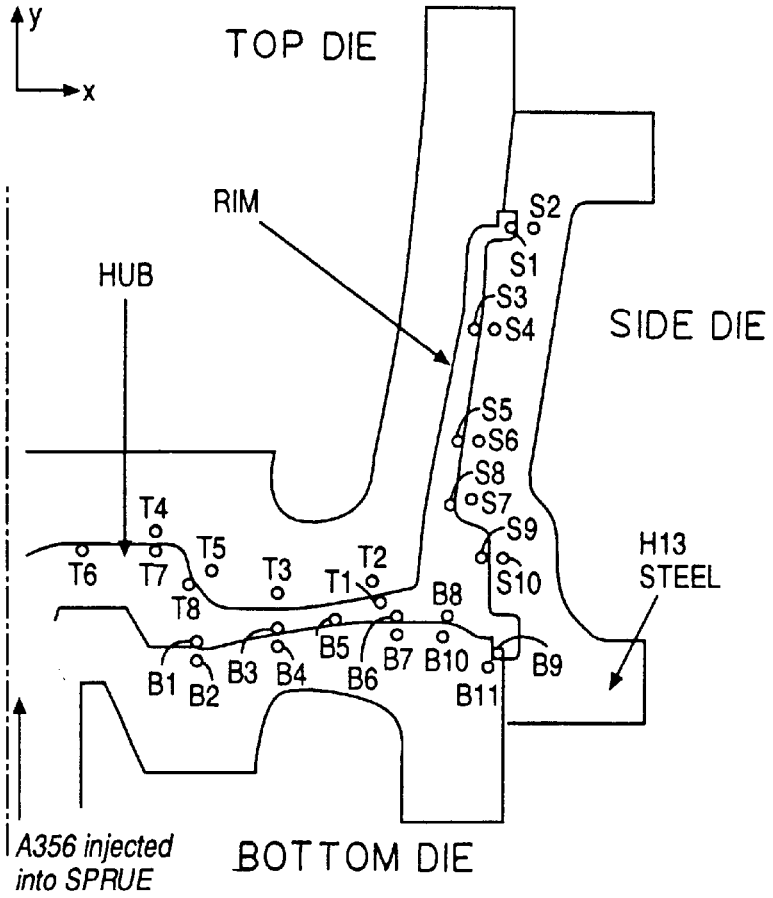
FIG. 5 is a schematic sectional diagram of one-half of the die assembly of FIG. 4, indicating location of thermocouples used for gathering experimental thermal characteristic information.

Part A of the optimization of this invention is to calibrate the revised finite element casting model with experimental data. As shown in FIG. 5, experimental data is gathered for the best mode, by strategically placing, for example, a total of about 29 type K thermo-couples (3 mm in diameter) in half of the wheel cavity and into half the dies to understand metal flow and thermal activity throughout the casting cycle. Note in FIG. 5 that thermo-couples associated with the bottom die are labeled B, those for the side die as S, and those for the top die as T. Fourteen of the thermo couples are in the cavity. The thermal history at each location was recorded at a sample rate of 10 Hz using a DM 605 digital data logger. A Nova-one dry-block calibrator (ranging from 150° C. to 1,250° C.) was used to calibrate the thermo-couples and the compensation in the data logger. The thermo-couples that protruded into the cavity are referred to as "through thermo-couples" and are indicated by a solid dot in the figure; the thermo-couples embedded in the metal of the dies is indicated with a different designation. The exposed portions of the through thermo-couples were sprayed with die coating to allow easy extraction from the solidified metal after solidification.

Once the casting model is calibrated to complete solidification modeling, numerical optimization is used, such as by use of a commercial software of DOT (a design optimization tool). However, the combination of the solidification model and the optimization algorithm requires an interface that does not exist today.

To calibrate the finite element model for low pressure die casting against the experimental data, two phases are used: phase 1 for filling transients, and phase 2 for solidification. To simulate filling of the cavity, it is necessary to determine initial conditions for the solidification phase and an accurate fill time. The objective function used for this part of the matching technique is expressed as $$F(x)=\sum_{i=1}^{N}(t_i^{expt}-t_i^{model})^2 \qquad \text{Equation 1}$$

where $t_i^{expt}$ and $t_i^{model}$ represent the times at which the ith thermo-couples and their respective nodes in the model first respond to the impact of the molten metal The summation was over the total number of cooling curves of the through thermo couples (N=15). The only design variable in the optimization was the Y component of velocity of the metal entering the sprue. The optimization was unconstrained and used the Broyden-Fletcher-Goldfarb-Shanno algorithm, which was an inherent part of existing DOT (design optimization tools) software. The optimization cannot rely on estimated values for the inlet velocity; the inlet velocity needs to be adjusted to match the initial response time of the through thermo-couples.

Figure 6:
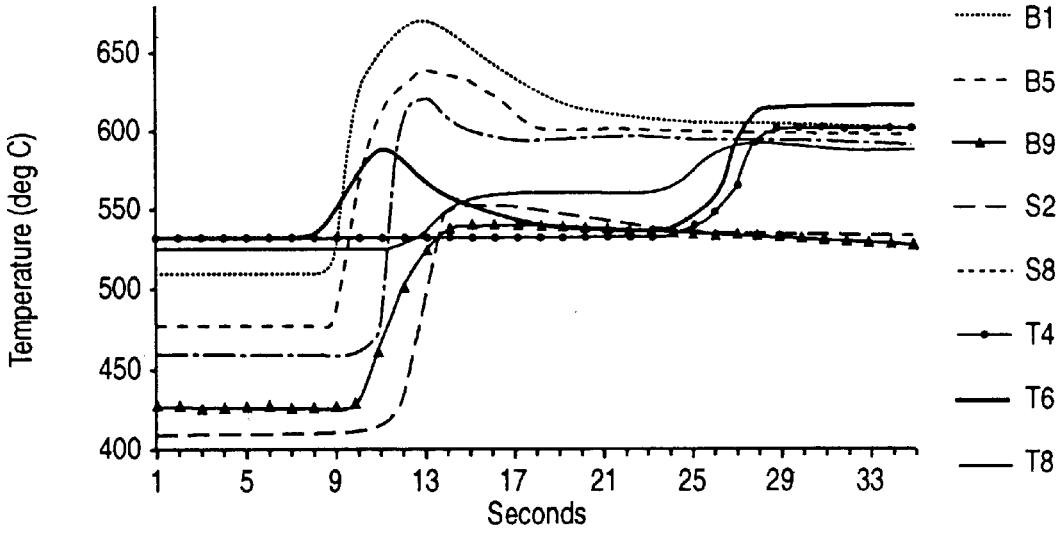
FIG. 6 is a graphical illustration of response time and temperature readings for the thermo-couples of FIG. 5, that extend into the casting cavity.
Figure 7A:
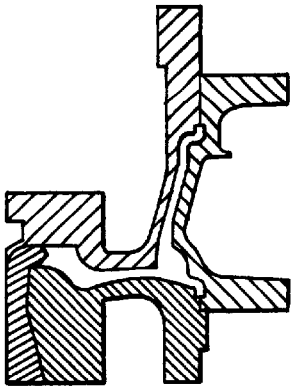
FIG. 7 is a composite sequence of the stages experienced in the filling of the mold cavity as per the computer simulation casting model of this invention.
Figure 7B:
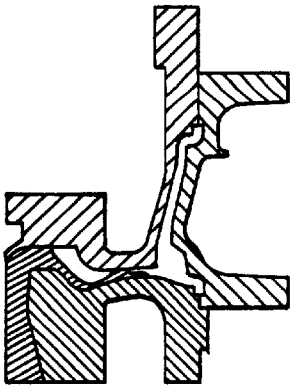
Figure 7C:
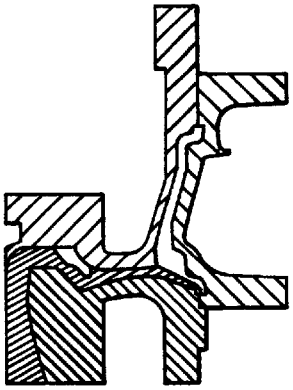
Figure 7D:
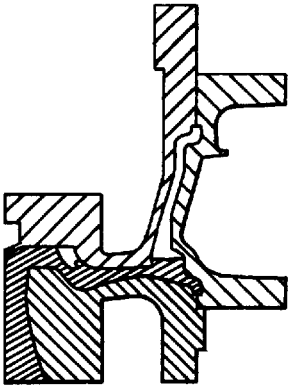
Figure 7E:
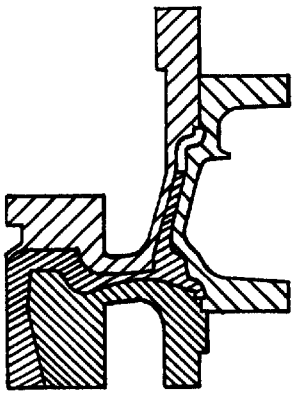
Figure 7F:
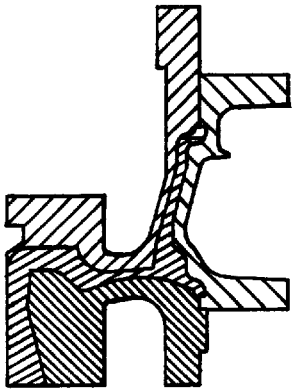

FIG. 6 is a plot of the initial thermal response times of the through thermo-couples. The graph shows that the time gap from the initial "splash" on the thermo couple T6 to the metal flowing to the end of the rim (S2) is approximately 4.5 seconds. A notable point is the apparently anomalous temperature histories of thermo-couples T4, T6 and T8, which although close to the entrance to the wheel cavity, exhibit delayed responses. The inlet velocity of the model was then adjusted to match the initial response times of the through thermo couples (taking into account the relative delays of each thermo couple).

This produced a flow pattern which is represented as a series of sequences in FIG. 7. FIG. 7 visualizes the low pressure die cast process filling sequence predicted by the model. A recirculation region around the hub area was found to be precisely where thermo-couples T4, T6 and T8 were positioned and proved to be the reason for the delayed thermo-couple responses. The delay time, as indicated in FIG. 6, also can be attributed to the fact that in the preparation of the die for the trial, the top section was heavily layered with die coating. High levels of porosity and gas entrapment are commonly found in prior art structure at the back of the wheel hub. The flow pattern sequences of FIG. 7 explain this defect. The calibrated model shows that the process has a much faster filling time than previously used for modeling. This demonstrates how experimental data and computer simulation can be used together to identify problematic areas of the industrial process.

Figure 8:
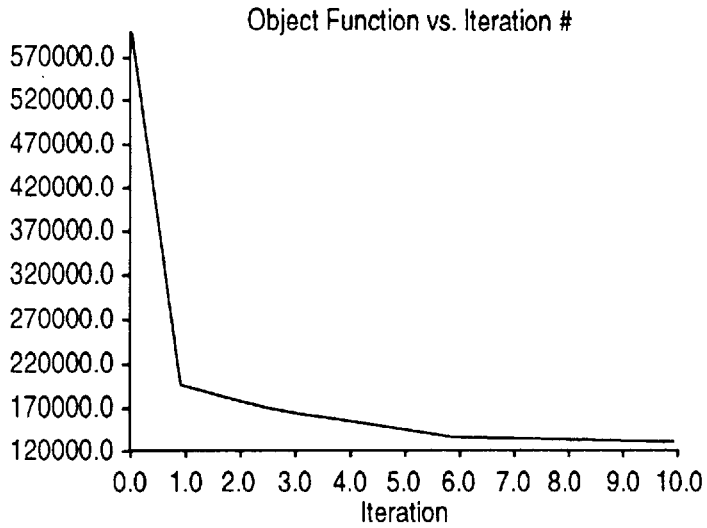
FIG. 8 is a graphical illustration of information depicting the history of an objective function for the preferred embodiment of this invention.

The last part of the calibration step focuses on how to find a distribution of temperature dependent heat transfer coefficients such that the computed and experimental cooling curves are closely matched. Although the heat transfer during solidification between the casting and the dies is a function of several variables, temperature is selected as the dominant variable. The objective function is expressed as $$F(x) = \sum_{i=1}^{2N} \sum_{j=1}^{M} (T_j^{model} - T_j^{expt})^2 \qquad \text{Equation 2}$$

where $T_j^{model}$ and $T_j^{expt}$ were the model and experimental temperatures at the $j^{th}$ time step and M was the total number of steps over which the optimization occurred. The second summarization was over all the thermo-couples (where N and i have been previously defined in equation 1). A constraint in this optimization problem is to maintain decreasing heat transfer coefficients with decreasing temperature to represent the formation of air gaps during solidification The sequential quadratic programming algorithm of the DOT software package was used. Several points on the three heat transfer coefficient versus temperature curves were selected as design variables, some for the bottom and side sections and some for the top section. The effective production range for the particular die casting system is between 500° C. and 710° C. As shown in FIG. 8, the equivalent of a 76% improvement in the objective function is realized.

Figure 9A:
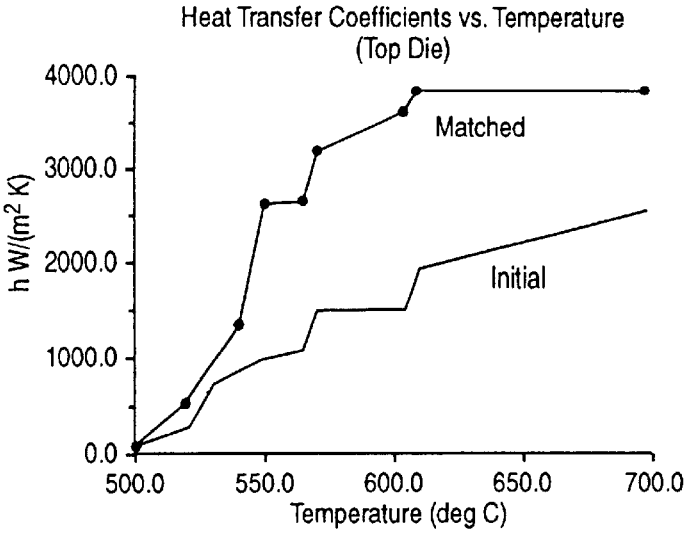
FIGS. 9A, 9B and 9C are a series or graphical comparisons of matched and initial heat transfer coefficients with respect to the top, bottom and side dies, respectively.
Figure 9B:
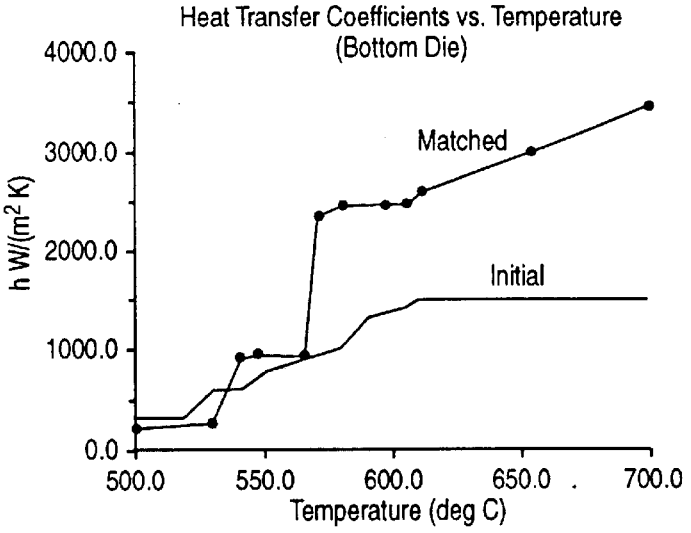
Figure 9C:
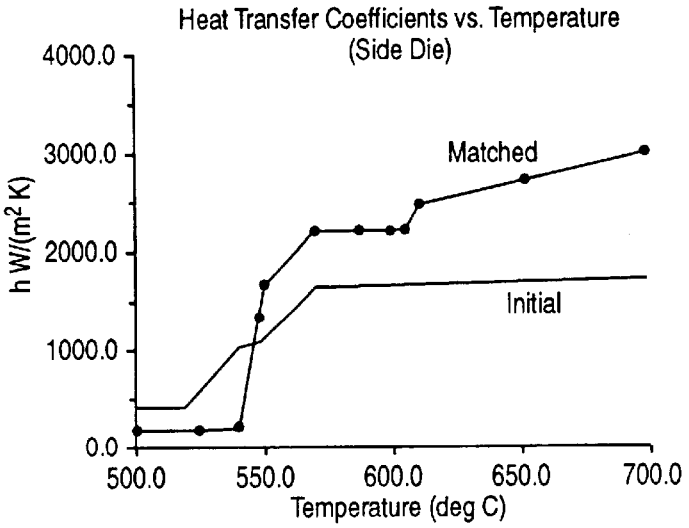
Figure 10A:
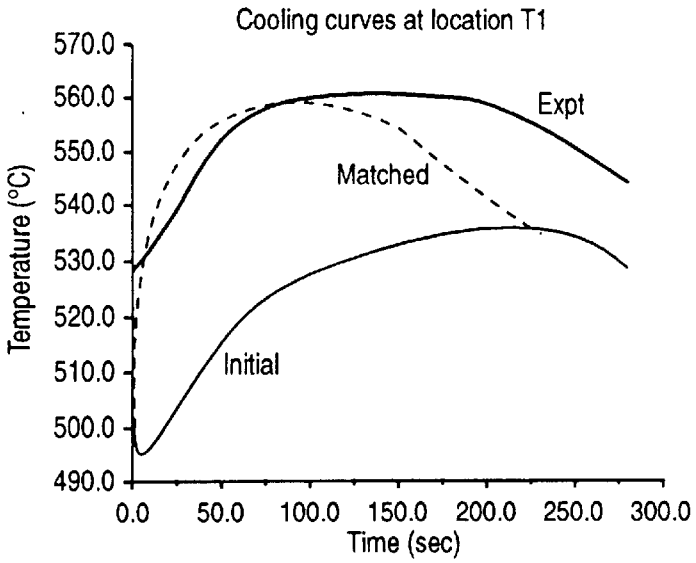
FIGS. 10A and 10B are graphical illustrations of cooling curves for matched experimental and model thermo profiles for the design of the die assembly, FIG. 10A being in the metal die and FIG. 10B being in the casting.
Figure 10B:
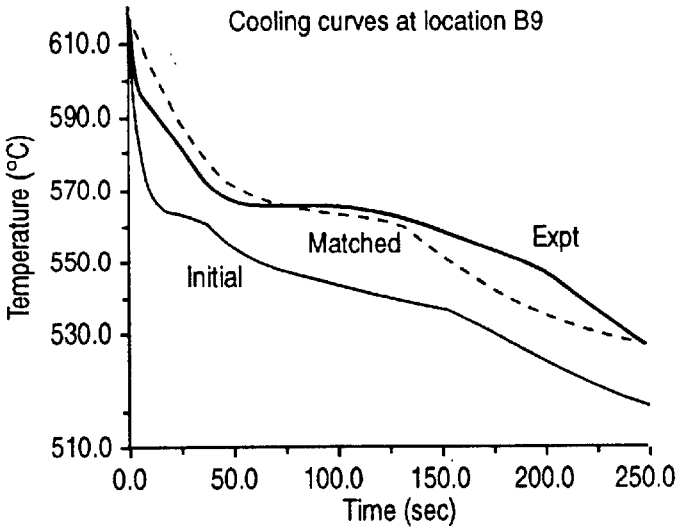
Figure 11:
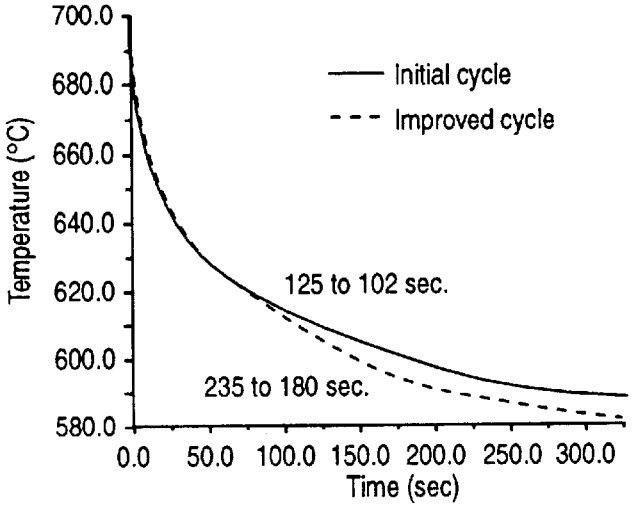
FIG. 11 is a graphical illustration of a cooling curve to optimize the die assembly design with optimum cooling circuit operations.
Figure 13:
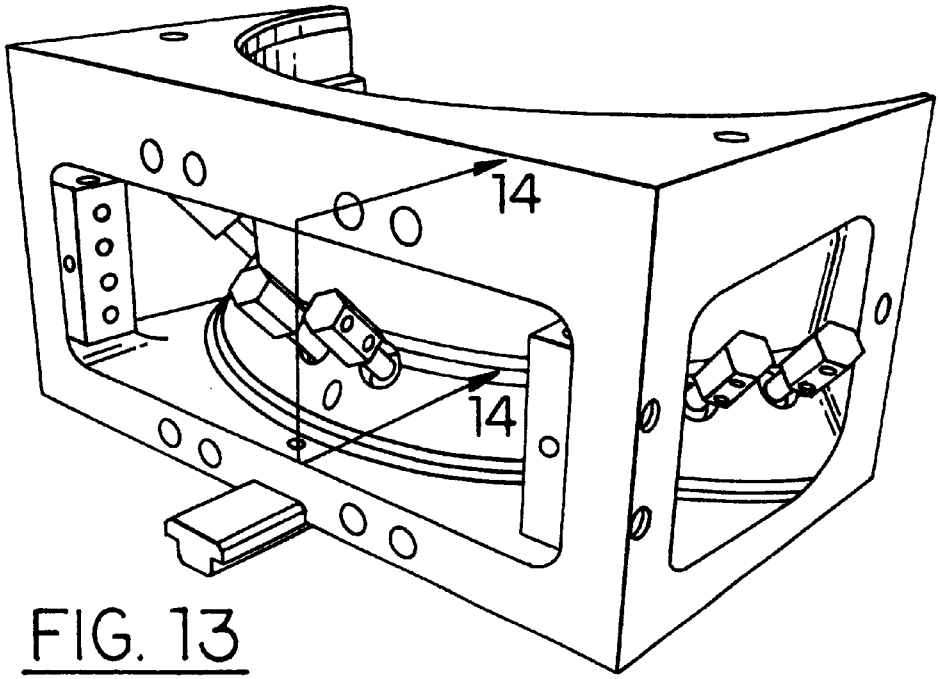
FIG. 13 is a perspective view of the side die showing two cooling circuit inlets and accompanying chills.
Figure 14:
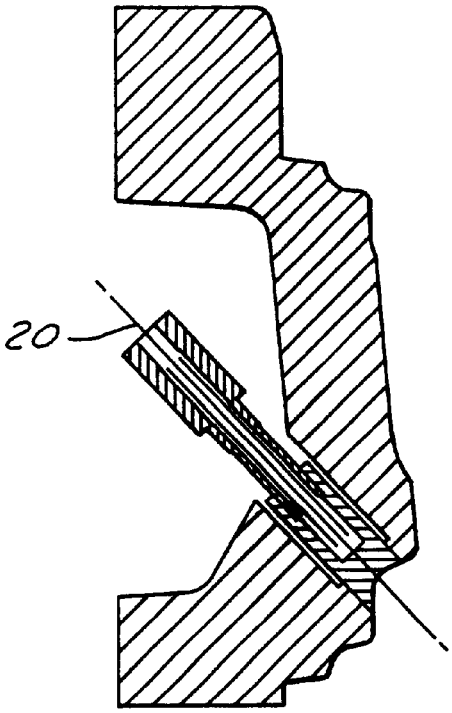
FIG. 14 is a sectional view of one of the cooling circuits taken along line 14—14 of FIG. 13.

Turning to FIGS. 9A–9C, the initial distributions of heat transfer coefficients for the. respective top, bottom and side dies are based on previous models and engineering experience. From FIGS. 8 and 9A–9C, cooling curves in the die and metal can be illustrated, such as shown in FIGS. 10A and 10B. Although the optimum cooling curves do not match the experiment exactly, they show more realistic solidification characteristics than the initial model. From the initial cooling curves and the attempt to make thermal conductivity and heat capacity as design variables, a diagrammatic color plot of the casting metal can be made at a selected time, such as t is equal to 150 sec. (as shown in FIG. 11). This plot indicates the degree of solidification at each subdivided region. From this plot, it is evident that the cooling is more rapid in the spoke area than in the rim/spoke junction during a typical casting cycle. The closed contour at the 40% fraction solid level in the rim/spoke junction is a result of multi-directional solidification patterns within the casting. This correctly indicates the formation of observed porosity in that area. The other highlighted areas are also common locations for observed defects in the production castings. These defects are the main reasons for unacceptably high scrap rates.

Once the casting model is calibrated to complete solidification modeling, numerical optimization is used, such as by use of a commercial software of DOT (a design optimization tool). However, the combination of the solidification model and the optimization algorithm requires an interface that does not exist today.

Having completed the calibration of the revised casting model, Part B of the optimization (review FIG. 2) is implemented by modifying thermophysical properties in the tooling to achieve a reduction in cycle time. A constraint is established to maintain a uni-directional, positive temperature gradient along the casting (i.e., solidifying from the rim to the sprue). This was necessary to reduce porosity and other related defects in key areas of the casting (such as the rim/spoke junction and hub). The constraint function was implemented in the finite element model by ensuring that certain selected nodes within the casting were maintained at a higher temperature than others throughout the cycle. The objective function in this part of the analysis was expressed as $$F(x)=(t1_{model}-t1_{target})^2+t2_{model}-t2_{target})^2 \qquad \text{Equation 3}$$

where $tn_{model}$ and $tn_{target}$ represent the model and target times of each cooling cycle, respectively. Thus, the equation was formulated to force the calibrated model to achieve an arbitrarily low cycle time so that the direction of improvement in the process, made by optimization could be determined. The lower cycle time is illustrated in FIG. 11. The two points on the target cooling curve used in equation 3 were 610° C. at $t1_{target}$ (102sec.) and 597° C. at $t2_{target}$ (180 sec.). The equation was calculated using the cooling curve of a node located in the sprue. This was based on the assumption that the sprue is the last part to solidify, hence a good indicator for the end of a cycle. This improvement corresponds to about a 78% decrease from the initial value of the objective function.

Figure 12:
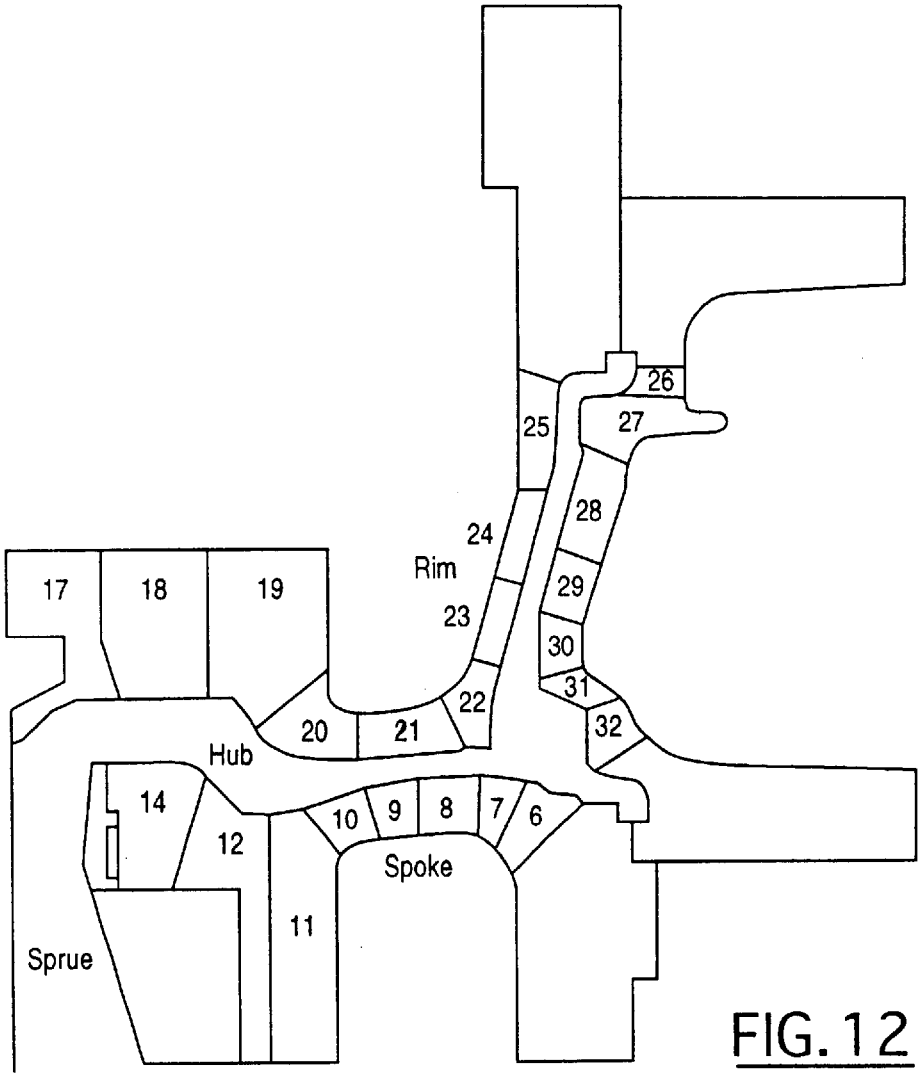
FIG. 12 is a schematic diagrammatic sectional view of half of the die assembly showing how the die is subdivided into contiguous regions, each region of which is worked by the objective functions.

This reduction in cycle time was achieved by optimizing thermal characteristics of the tooling in about 30 locations throughout the die (shown in FIG. 12 ). Thus, there were 60 design variables comprising the thermal conductivity and thermal capacity in each section. With prior calibrated models, there is a closed contour at the 40% of solid level at the rim/spoke junction that produces premature solidification in the wheel spoke. By modifying physical properties at the rim/spoke junction, spoke and hub areas of the tooling, a directional solidification pattern can be achieved throughout the casting.

Part C of the optimization model requires locating the chills, cooling circuits and insulation by interpretation of the thermo-physical properties of the model at the sections of FIG. 12, the changed rate of heat extraction tells one where to place cooling circuits, chills and insulation to attain uni-directional solidification without porosity. The location of insulating materials in the mold, as suggested by FIG. 12, at positions 8, 9 and 21, would not be effective in the long term operation of the dies, as they would suffer thermal fatigue, cracking and other related problems due to the high cyclic temperature range (450° C.–575° C.) in that area. Consequently, an insulating foam sleeve was used to cover the external die surface to minimize heat loss via convection and radiation to the surroundings.

Figure 16:
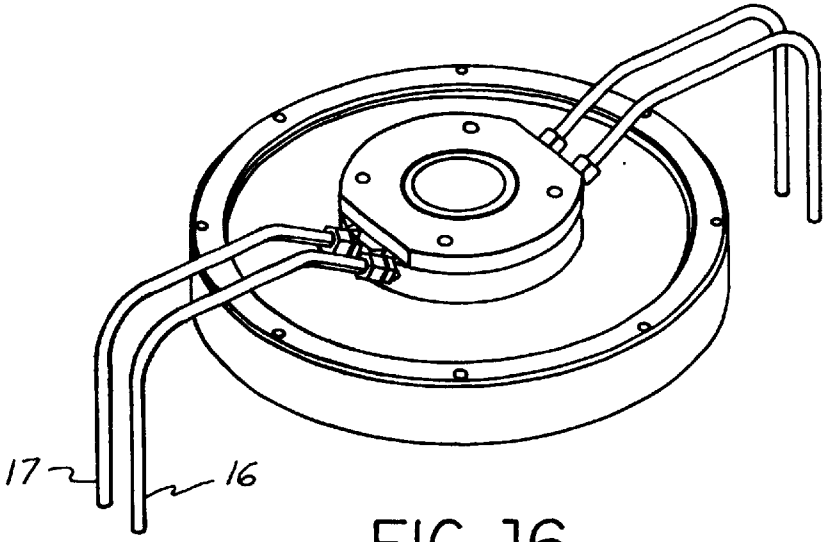
FIGS. 15 and 16 are each perspective views of the top and bottom dies, respectively, showing some details of the cooling circuit arrangements.
Figure 15:
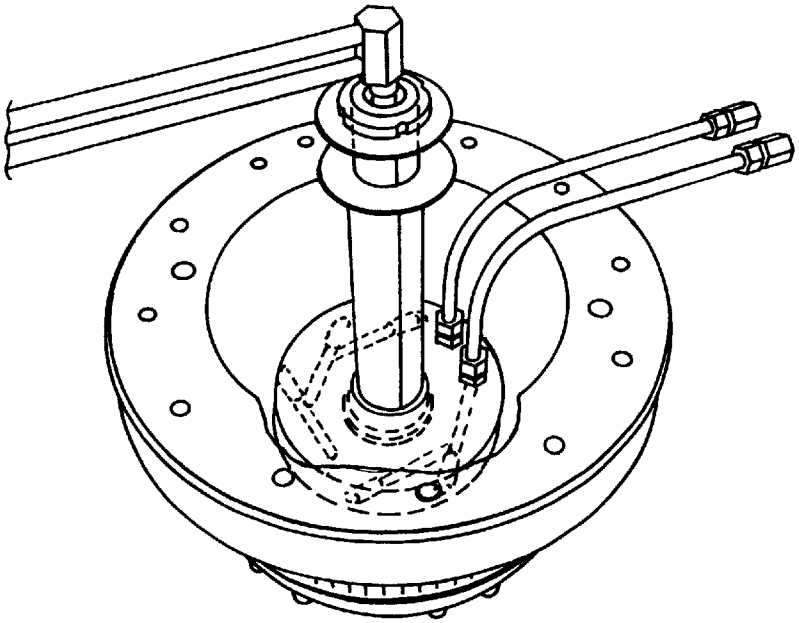
Figure 17:
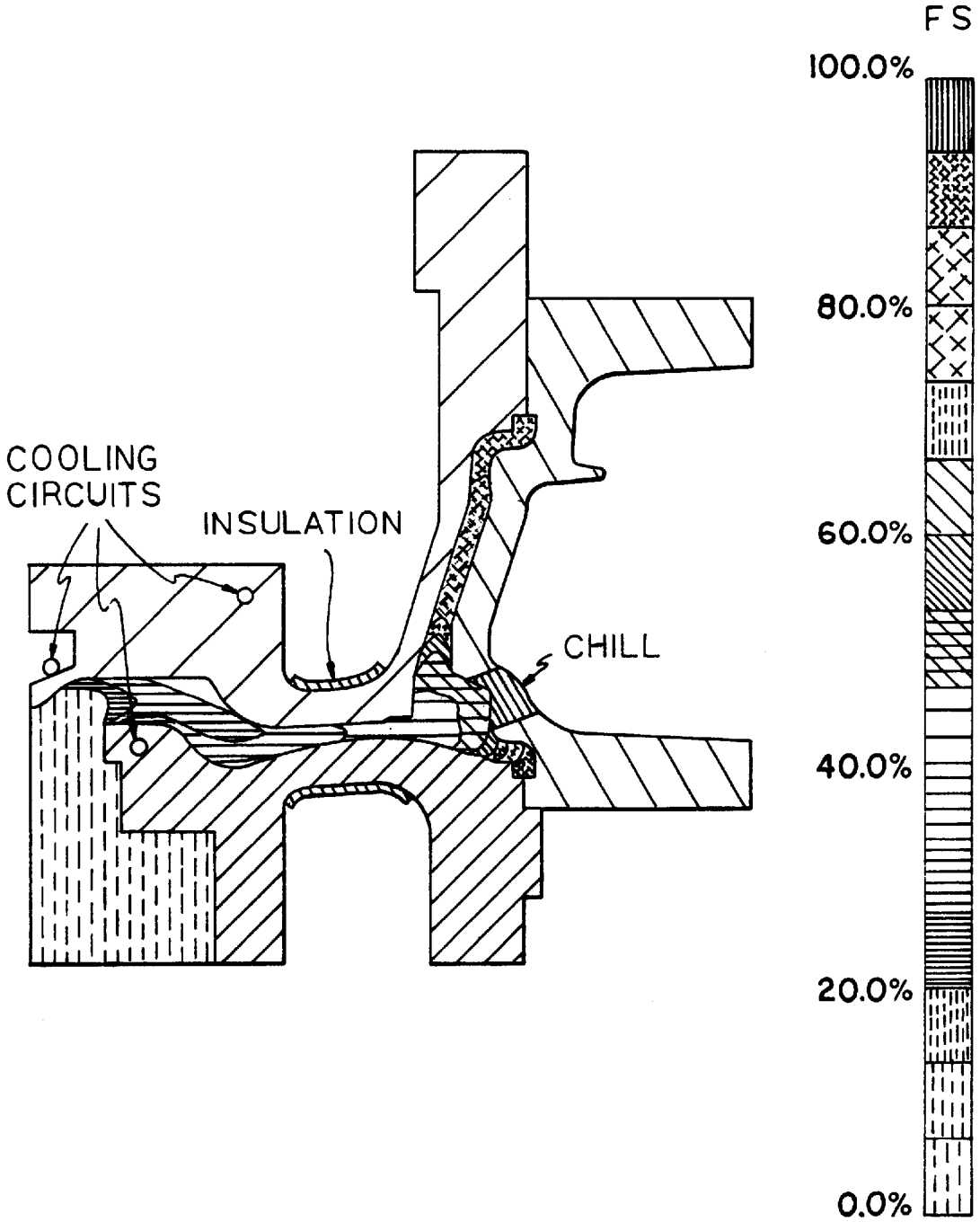
FIG. 17 is a schematic sectional view, like that in FIG. 12 of the die assembly, showing uni-directional solidification and thermal properties of the die assembly.

Referring to FIGS. 12 and 17, cooling circuit 16 was placed near the hub at position 19 and circuits 18 and 19 near the sprue at positions 14 and 17; chills modeled in those locations caused premature solidification in the hub, and hence did not produce the required solidification pattern. By sequentially timing application of the cooling circuits 16, 18 and 19 at positions 19, 17 and 17 of FIG. 12, the requirements of a low cycle time and directional solidification can be assured. As indicated in FIGS. 3 and 4, and further amplified by FIGS. 13–16, a total of six water cooling circuits was employed, two cooling circuits 18 and 19 in the top die, two cooling circuits 16 and 17 in he bottom die, and five cooling circuits 20–24 for the five pairs of chills located at each rim/spoke junction of the wheel. For each of the top die cooling circuits 18 and 19, a spot cooling technique is used, a shown in FIG. 15, in which a specific location in the casting is targeted. For circuits 18 and 19, a ringed cooling technique is used to deliver cooling to a wider area in the casting. Similar use of a spot cooling circuit, as well as a ringed cooling circuit, is employed in the bottom die, as shown in FIG. 16.

A water cooled chill needs to be located at positions 31 and 32 to avoid premature solidification at the rim/spoke junction in the casting. Ahead of this juncture, heat was being withdrawn too rapidly causing premature solidification at the spoke areas (8, 9, 21); this caused high porosity at the rim/spoke juncture.

The results of the die design methodology is implemented into the design of the tooling; this is based entirely on the optimum computational model for the locations of cooling and insulation.

Figure 18:
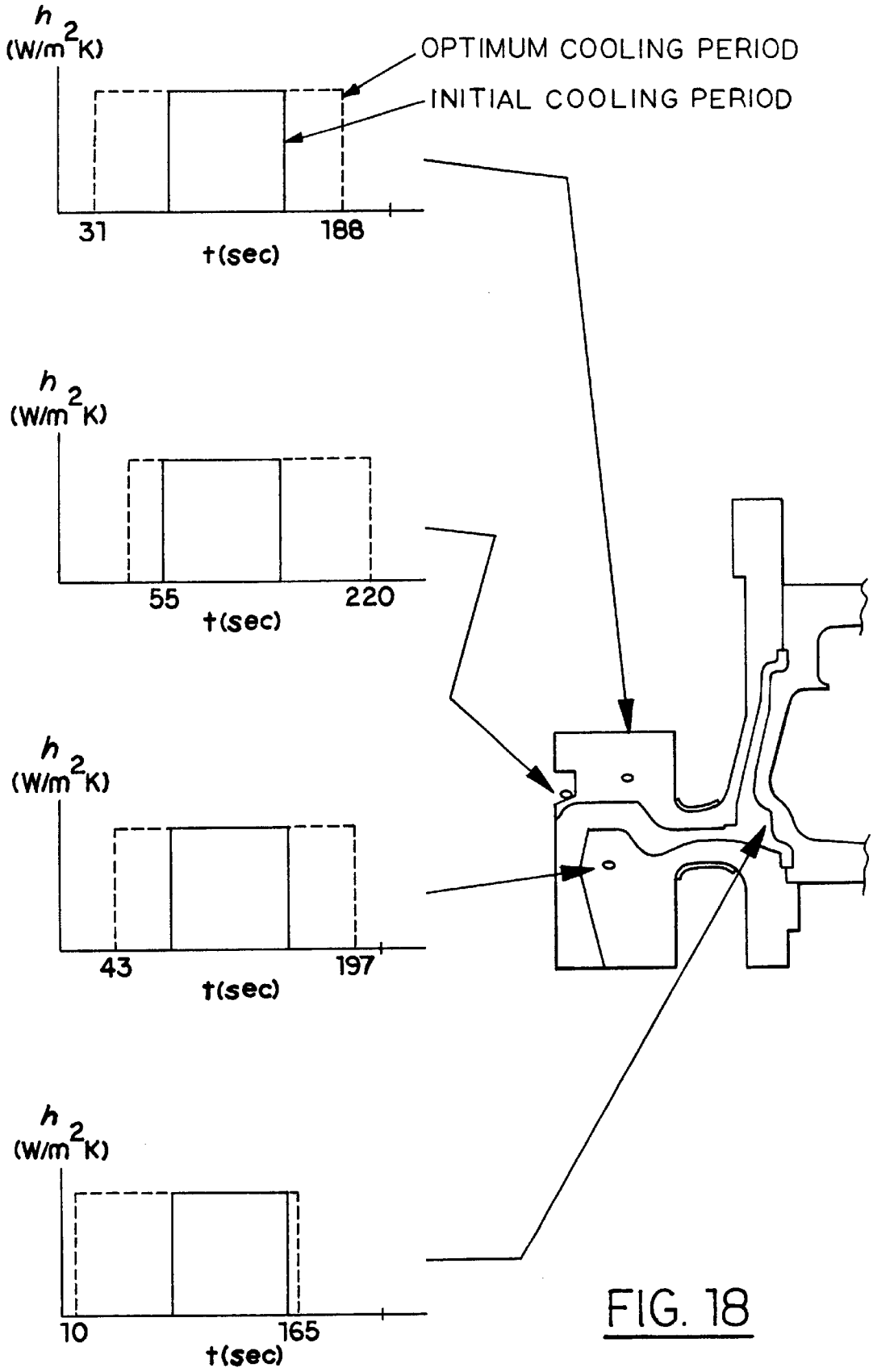
FIG. 18 is a composite view of FIG. 17 and graphical illustrations of heat transfer at the three cooling circuits and at the water cooled chill.

Part D of the optimization objective is to determine the optimum period for each cooling circuit to be on or off. The optimum thermo-physical properties, calculated previously, are kept constant and the activation time of each cooling circuit is used as a design variable for the analysis. A total of eight design variables were selected, representing four "on" times and four "off" times of each cooling circuit in the dies. The objective was to achieve a low cycle time, while maintaining positive temperature gradients throughout the casting. The objective and constraints were the same as those described in equation 3. The initial target for cooling circuit optimization is a cooling curve with an arbitrarily low cycle time to determine directions of change for each design variable. FIG. 18 reveals plots of heat transfer a function of time for the arbitrarily chosen initial period and for the calculated optimum period of the water cooled chill and three cooling circuits in the hub and sprue area of the improved model. While satisfying all convergent criteria for optimization, the analysis resulted in an improved cycle time with directional solidification. The optimization was repeated with a different initial location of design variables in the design space, and the optimum results converged to a similar solution.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

What is claimed is:

1. A method of optimizing cycle time and/or casting quality in the making of a cast metal product defined by a CAD product model, comprising the steps of:

(a) providing a computer casting model using objective functions that simulate the filling and solidification of the CAD product model within a die, the casting model being subdivided into contiguous regions with each region having its own terms in at least one of the objective functions for thermal conductivity, heat capacity and cooling time period;

(b) adapting the objective function terms based on experimental data to calibrate the casting model measured thermal data, derive matching heat transfer coefficients for each region, and simulate filling and solidification of the product within said die; and (c) constraining the objective functions to ensure directional solidification along the series of contiguous sections while optimizing thermal conductivity and heat capacity, and iterativately evaluating the constrained objective functions to indicate which regions ofthe casting model can have chills, cooling channels or insulation added to effect improved cycle time and/or casting quality.

2. A method of optimizing cycle time and/or casting quality in the making of a cast metal product defined by a CAD product model comprising:

providing a computer casting model using objective functions that simulate the filling and solidification of the CAD product model within a die, the casting model being subdivided into contiguous regions with each region having its own terms in at least one of the objective functions for thermal conductivity, heat capacity and cooling time period;

adapting the objective function terms based on experimental data to calibrate the casting model measured thermal data, derive matching heat transfer coefficients for each region, and simulate filling and solidification of the product within said die;

constraining the objective functions to ensure directional solidification along the series of contiguous sections while optimizing thermal conductivity and heat capacity, and iterativately evaluating the constrained objective functions to indicate at least certain regions of the casting model whereby chills, cooling channels may be added or insulation added to effect improved cycle time and/or casting quality; and based on the iterative evaluation, translating the die design of the casting model into physical dies having cooling channel circuits with varying on and off cooling times to optimize the cooling time periods.

3. The method as in claim 1, in which the product model is for a cast aluminum wheel for an automotive application and the objective function for determining initial conditions for the solidification phase takes the form of $$F(x) = \sum_{i=1}^{N} (t_i^{expt} - t_i^{model})^2 \qquad \text{Equation 1}$$

where $t_i^{expt}$ and $t_i^{model}$ represent the times at which the $i^{th}$ thermo-couples and their respective nodes in the model first respond to the impact of the molten metal.

4. The method as in claim 1, in which the constrained objective function takes the form of $$F(x)=(t1_{model}-t1_{target})^2+t2_{model}-t2_{target})^2 \qquad \text{Equation 3}$$

where $tn_{model}$ and $tn_{target}$ represent the model and target times of each cooling cycle, respectively.

5. The method as in claim 1, in which said cycle time is reduced to about 70–80% of the initial cycle time.

* * * * *